US009057384B2

(12) United States Patent
Chen et al.

(10) Patent No.: US 9,057,384 B2
(45) Date of Patent: Jun. 16, 2015

(54) INTEGRATED FAN

(75) Inventors: Lee-Long Chen, Taoyuan Hsien (TW); Zse-Hsin Wang, Taoyuan Hsien (TW); Chien-Hsiung Huang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 854 days.

(21) Appl. No.: 13/233,342

(22) Filed: Sep. 15, 2011

(65) Prior Publication Data

US 2012/0070277 A1 Mar. 22, 2012

(30) Foreign Application Priority Data

Sep. 16, 2010 (TW) ..... 099131380

(51) Int. Cl.
*F04D 25/08* (2006.01)
*F04D 29/44* (2006.01)
*F04D 29/42* (2006.01)

(52) U.S. Cl.
CPC ..... *F04D 29/4226* (2013.01); *F04D 25/08* (2013.01); *F04D 29/441* (2013.01)

(58) Field of Classification Search
CPC .... F04D 25/08; F04D 29/4226; F04D 29/441
USPC ..... 415/211.2, 213.1, 214.1, 215.1, 206, 415/178
See application file for complete search history.

(56) References Cited

U.S. PATENT DOCUMENTS 6,050,774 A * 4/2000 LeBaron ..... 415/121.2
6,478,538 B2 * 11/2002 Kim ..... 415/204
2011/0008152 A1 1/2011 Liu

FOREIGN PATENT DOCUMENTS

CN 2443419 Y 8/2001
CN 1553059 A 12/2004
CN 1721709 A 1/2006

* cited by examiner

*Primary Examiner* — Edward Look
*Assistant Examiner* — Jesse Prager
(74) *Attorney, Agent, or Firm* — Kirton McConkie; Evan R. Witt

(57) ABSTRACT

An integrated fan includes a centrifugal blade unit and a frame. The centrifugal blade unit has a hub. The frame is used for accommodating the centrifugal blade unit. The frame includes a first casing, a second casing and at least one airflow-guiding plate. The first casing includes a main plate and an airflow inlet, wherein the airflow inlet is disposed in the main plate and aligned with the hub. The second casing is opposed to the main plate of the first casing. The at least one airflow-guiding plate is aslant and externally extended from an edge of the main plate. The airflow-guiding plate, the first casing and the second casing collectively define an airflow output channel. An included angle between an airflow-leaving direction of the airflow output channel and an airflow-entering direction of the airflow inlet is ranged between 90 and 180 degrees.

3 Claims, 5 Drawing Sheets

INTEGRATED FAN

FIELD OF THE INVENTION

The present invention relates to an integrated fan, and more particularly to an integrated fan with the benefits of an axial-flow fan and a centrifugal fan.

BACKGROUND OF THE INVENTION

With rapid development of high-tech industries, various electronic devices such as computer or servers become essential in our lives. As known, the heat-dissipating efficacy of the electronic device influences the operating stability and the use life of the overall system. For increasing the heat-dissipating efficacy of the electronic device, a cooling device is usually installed within the electronic device or the ambient environment to cool the electronic device.

As known, an air-cooled heat exchanger is one of the common coolers for guiding the ambient air to cool the electronic components within the electronic device. Generally, the air-cooled heat exchanger has a first fan and a second fan. The first fan performs an internal circulation. By the internal circulation, the indoor hot airflow generated from the electronic device is inhaled into the air-cooled heat exchanger through an upper position of the air-cooled heat exchanger. The second fan performs an external circulation. By the external circulation, the ambient cool airflow is introduced into the air-cooled heat exchanger through a lower position of the air-cooled heat exchanger. Through plural heat-dissipating fins within the air-cooled heat exchanger, the heat of the indoor hot airflow is transferred to the ambient cool air. In such way, the temperature of the electronic device is reduced.

The second fan of the air-cooled heat exchanger is an axial-flow fan or a centrifugal fan. Generally, the axial-flow fan may result in a relatively higher capacity of airflow. In addition, the airflow-entering direction and the airflow-leaving direction of the axial-flow fan are identical. As such, the heated ambient cool airflow can be effectively exhausted to the surroundings. The axial-flow fan, however, generates undesired noise. In addition, in a case that the air-cooled heat exchanger with the axial-flow fan is operated in a high air-resistance occasion or an obstructing object is placed at the airflow outlet side of the axial-flow fan, the air pressure acting on the airflow outlet side of the axial-flow fan is obviously attenuated. Under this circumstance, the airflow capacity is largely reduced, and thus the heat-dissipating efficacy of the air-cooled heat exchanger is impaired.

Although the centrifugal fan has low noise and large air pressure, there are still some drawbacks. For example, since the angle between the airflow-entering direction and the airflow-leaving direction of the centrifugal fan is substantially 90 degrees, the air-cooled heat exchanger is usually equipped with an additional hood at the airflow outlet side. As such, the heated ambient cool airflow within the air-cooled heat exchanger is introduced into the airflow inlet of the centrifugal fan, then turned by 90 degrees, and finally exhausted to the surroundings through the hood. However, the use of the additional hood increases the fabricating cost of the air-cooled heat exchanger.

Therefore, there is a need of providing an integrated fan with the benefits of an axial-flow fan and a centrifugal fan to obviate the drawbacks encountered from the prior art.

SUMMARY OF THE INVENTION

The present invention provides an integrated fan with the benefits of an axial-flow fan (e.g. low noise and large air pressure) and the benefits of a centrifugal fan (e.g. high airflow capacity), so that it is not necessary to install an additional hood on the air-cooled heat exchanger.

In accordance with an aspect of the present invention, there is provided an integrated fan for use in a cooling device. The integrated fan includes a centrifugal blade unit and a frame. The centrifugal blade unit has a hub. The frame is used for accommodating the centrifugal blade unit. The frame includes a first casing, a second casing and at least one airflow-guiding plate. The first casing includes a main plate and an airflow inlet, wherein the airflow inlet is disposed in the main plate and aligned with the hub. The second casing is opposed to the main plate of the first casing. The at least one airflow-guiding plate is aslant and externally extended from an edge of the main plate. The airflow-guiding plate, the first casing and the second casing collectively define an airflow output channel. An included angle between an airflow-leaving direction of the airflow output channel and an airflow-entering direction of the airflow inlet is ranged between 90 and 180 degrees.

In accordance with another aspect of the present invention, there is provided an integrated fan for use in a cooling device. The integrated fan includes a centrifugal blade unit and a frame. The centrifugal blade unit has a hub. The frame is used for accommodating the centrifugal blade unit. The frame includes a first casing, a second casing and plural airflow-guiding plates. The first casing includes a main plate and an airflow inlet, wherein the airflow inlet is disposed in the main plate and aligned with the hub. The second casing is opposed to the main plate of the first casing. The plural airflow-guiding plates are aslant and externally extended from plural edges of the main plate and connected with the second casing. Every two adjacent airflow-guiding plates, the first casing and the second casing collectively define an airflow output channel. An included angle between an airflow-leaving direction of the airflow output channel and an airflow-entering direction of the airflow inlet is ranged between 90 and 180 degrees.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
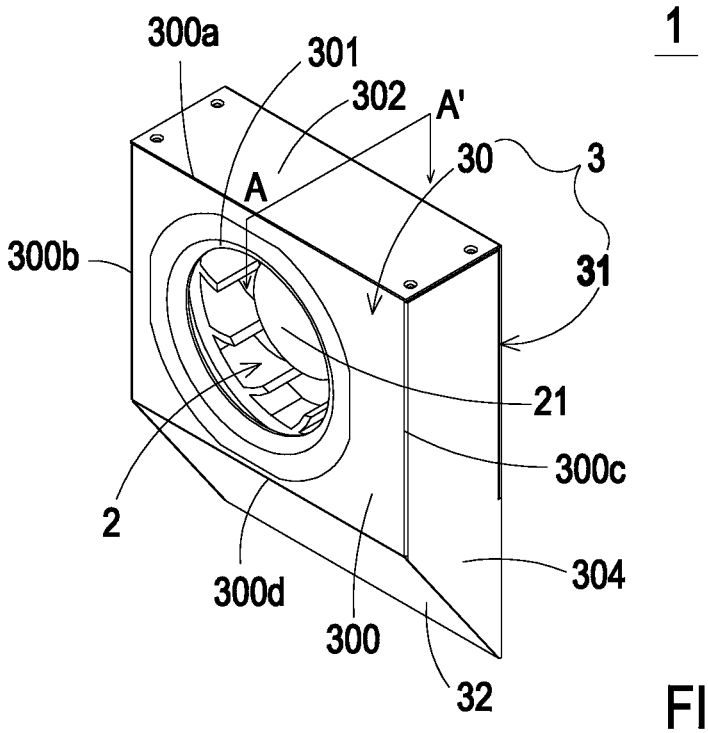
FIG. 1 is a schematic front view illustrating an integrated fan according to a first embodiment of the present invention.
Figure 2:
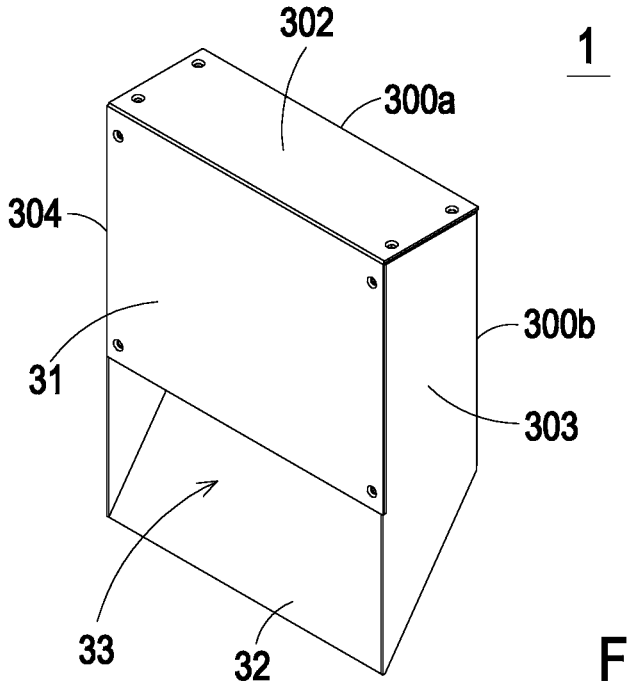
FIG. 2 is a schematic rear view illustrating the integrated fan shown in FIG. 1.
Figure 3:
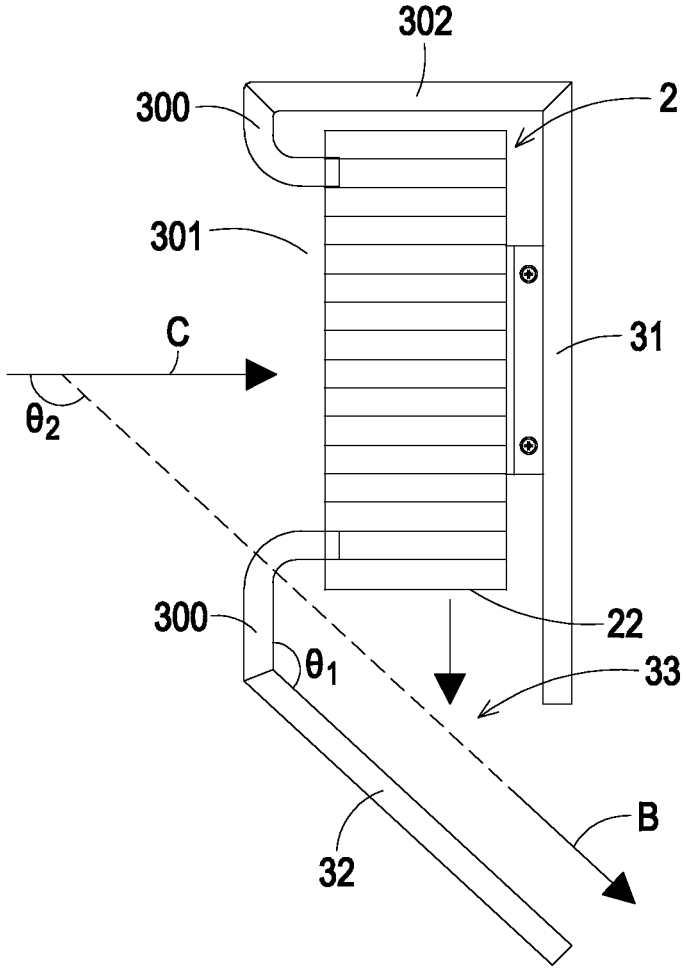
FIG. 3 is a schematic cross-sectional view illustrating the integrated fan shown in FIG. 1 and taken along the line A-A'.

FIG. 1 is a schematic front view illustrating an integrated fan according to a first embodiment of the present invention. FIG. 2 is a schematic rear view illustrating the integrated fan shown in FIG. 1. FIG. 3 is a schematic cross-sectional view illustrating the integrated fan shown in FIG. 1 and taken along the line A-A'. Please refer to FIGS. 1, 2 and 3. The integrated fan 1 includes a centrifugal blade unit 2 and a frame 3. The centrifugal blade unit 2 is rotatable and arranged within the frame 3. That is, the centrifugal blade unit 2 is completely enclosed by the frame 3.

The frame 3 includes a first casing 30, a second casing 31 and an airflow-guiding plate 32. The first casing 30 includes a main plate 300, an airflow inlet 301, a first lateral plate 302, a second lateral plate 303 and a third lateral plate 304. The airflow inlet 301 is disposed in the main plate 300, and aligned with the hub 21 of the centrifugal blade unit 2. Upon rotation of the centrifugal blade unit 2, the airflow is driven and introduced into the space within the frame 3 through the airflow inlet 301. The first lateral plate 302, the second lateral plate 303 and the third lateral plate 304 are vertically extended from a first edge 300*a*, a second edge 300*b* and a third edge 300*c* of the main plate 300, respectively. The second lateral plate 303 and the third lateral plate 304 are opposed to each other. The first lateral plate 302 is interconnected between the second lateral plate 303 and the third lateral plate 304.

The airflow-guiding plate 32 is aslant and externally extended from a fourth edge 300*d* of the main plate 300. An included angle θ1 between the airflow-guiding plate 32 and the main plate 300 is ranged between 90 and 180 degrees. In addition, when the airflow-guiding plate 32 is aslant and externally extended from the main plate 300, the airflow-guiding plate 32 is interconnected between the second lateral plate 303 and the third lateral plate 304, and opposed to the first lateral plate 302. In addition, the airflow-guiding plate 3 is aligned with an outer periphery 22 of the centrifugal blade unit 2. As such, upon rotation of the centrifugal blade unit 2, the airflow is introduced into the airflow inlet 301, and then turned by 90 degrees to be blown out of the outer periphery 22 of the centrifugal blade unit 2. Since the airflow blown out of the outer periphery 22 is hindered by the airflow-guiding plate 32, the path of the airflow is changed. In some embodiment, the airflow-guiding plate 32 is integrally formed with the main plate 300 of the first casing 30.

The second casing 31 is opposed to the main plate 300 of the first casing 30. In addition, the second casing 32 is connected with the first lateral plate 302, the second lateral plate 303 and the third lateral plate 304 of the first casing 31 for sheltering the centrifugal blade unit 2.

Please refer to FIGS. 2 and 3 again. Since the centrifugal blade unit 2 is sheltered by the second casing 31, the airflow-guiding plate 32, the first casing 30 and the second casing 31 collectively define an airflow output channel 33. The airflow output channel 33 is partially aligned with the outer periphery 22 of the centrifugal blade unit 2. Via the airflow output channel 33, the airflow blown out of the outer periphery 22 is guided and exhaust out of the frame 3. Since the airflow-guiding plate 32 is tilted and the included angle θ1 between the airflow-guiding plate 32 and the main plate 300 is ranged between 90 and 180 degrees, there is an included angle θ2 between the airflow-leaving direction B of the airflow output channel 33 and the airflow-entering direction C of the airflow inlet 301 (see FIG. 3). Upon rotation of the centrifugal blade unit 2, the included angle θ2 between the direction of the airflow introduced through the airflow inlet 301 and the direction of the airflow blown out of the airflow output channel 33 is more than 90 degrees and less than 180 degrees. Unlike the typical centrifugal fan, the included angle θ2 between the airflow-entering direction and the airflow-leaving direction of the integrated fan 1 is no longer 90 degrees. Due to the centrifugal blade unit 2, the integrated fan 1 has the benefits of the typical centrifugal fan (e.g. low noise and large air pressure). In addition, due to the airflow-guiding plate 32, the integrated fan 1 of the present invention also has the advantages of the typical axial-flow fan (e.g. high airflow capacity).

Figure 4:
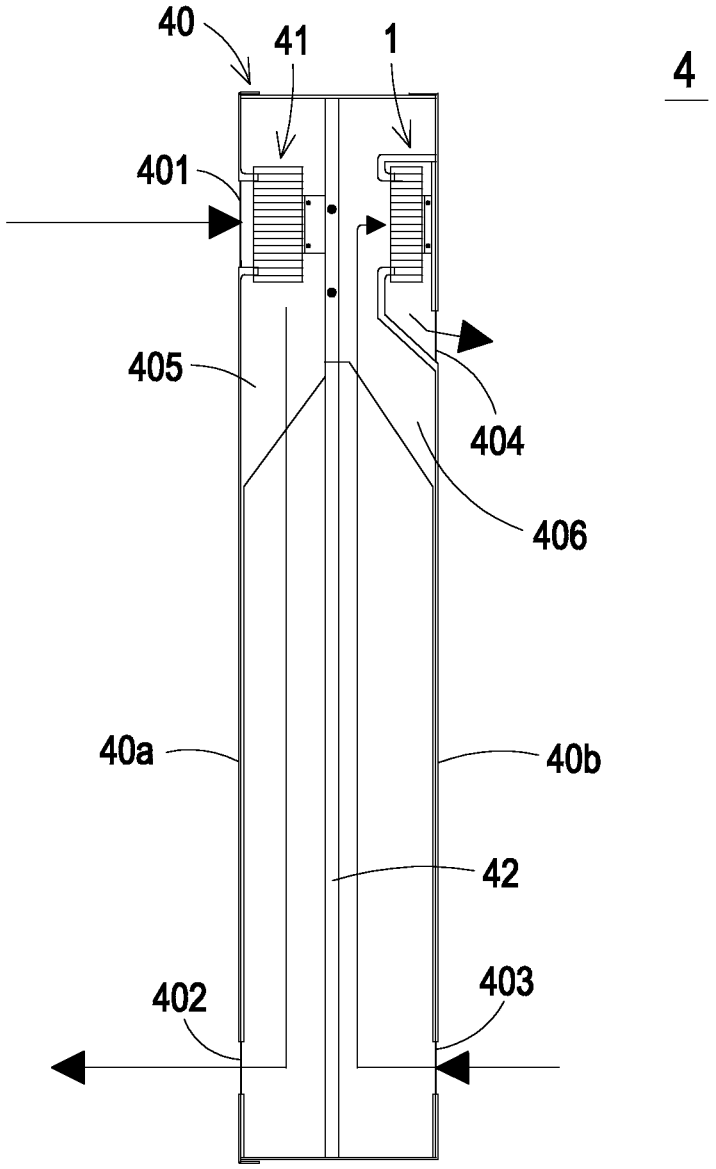
FIG. 4 is a schematic view illustrating an air-cooled heat exchanger having the integrated fan shown in FIG. 1.

FIG. 4 is a schematic view illustrating an air-cooled heat exchanger having the integrated fan shown in FIG. 1. Please refer to FIGS. 1~4. The air-cooled heat exchanger 4 is used for inhaling ambient cool airflow to reduce the temperature of the indoor airflow. The air-cooled heat exchanger 4 comprises a main body 40, a centrifugal fan 41, an integrated fan 1 (see FIGS. 1~3) and a heat exchanging core 42. The main body 40 has a first inlet opening 401, a first outlet opening 402, a second inlet opening 403, a second outlet opening 404, a first receptacle 405 and a second receptacle 406. The first receptacle 405 and the second receptacle 406 are not in fluid communication with each other. The first inlet opening 401 and the first outlet opening 402 are in communication with the first receptacle 405. In addition, the first inlet opening 401 and the first outlet opening 402 are respectively arranged at an upper position and a lower position of a first sidewall 40*a* of the main body 40. The second inlet opening 403 and the second outlet opening 404 are in communication with the second receptacle 406. In addition, the second inlet opening 403 and the second outlet opening 404 are respectively arranged at a lower position and an upper position of a second sidewall 40*b* of the main body 40.

The centrifugal fan 41 is arranged at the upper position of the first receptacle 405 and aligned with the first inlet opening 401 for performing an internal circulation. That is, the centrifugal fan 41 is used for inhaling the indoor hot airflow into the first receptacle 405 through the first inlet opening 401, guiding the airflow downwardly, and exhausting the airflow through the first outlet opening 402.

The integrated fan 1 is arranged at the upper position of the second receptacle 406. The airflow output channel 33 of the integrated fan 1 is in fluid communication with the second outlet opening 404. The integrated fan 1 is used for performing external circulation. That is, the integrated fan 1 is used for inhaling the ambient cool airflow into the second receptacle 406 through the second inlet opening 403, guiding the airflow upwardly, and exhausting the airflow through the airflow inlet 301 and the airflow output channel 33 of the integrated fan 1 and the second outlet opening 404.

The heat exchanging core 42 is arranged between the first receptacle 405 and the second receptacle 406. Through the heat exchanging core 42, heat exchange between the hot airflow within the first receptacle 405 and the cool airflow within the second receptacle 406 is rendered. Consequently, the heat of the airflow within the first receptacle 405 is transferred to the second receptacle 406, and guided and exhausted to the surroundings by the integrated fan 1.

Since the integrated fan 1 uses the centrifugal blade unit 2, the air-cooled heat exchanger 4 may be operated in a high air-resistance occasion and the noise is reduced. In addition, since the airflow-guiding plate 32 is tilted and the included, the included angle θ2 between the direction of the airflow introduced through the airflow inlet 301 and the direction of the airflow blown out of the airflow output channel 33 is more than 90 degrees and less than 180 degrees. That is, the included angle θ2 between the airflow-entering direction and the airflow-leaving direction of the integrated fan 1 is no longer 90 degrees. Meanwhile, the integrated fan 1 has the benefits of the typical axial-flow fan. Under this circumstance, it is not necessary to install an additional hood on the air-cooled heat exchanger 4 to prevent the airflow downwardly blown out of the outer periphery 22 of the centrifugal blade unit 2 from hindering the cool airflow, which is inhaled through the second inlet opening 403 and transported upwardly. Consequently, the fabricating cost of the air-cooled heat exchanger 4 is reduced.

Figure 5:
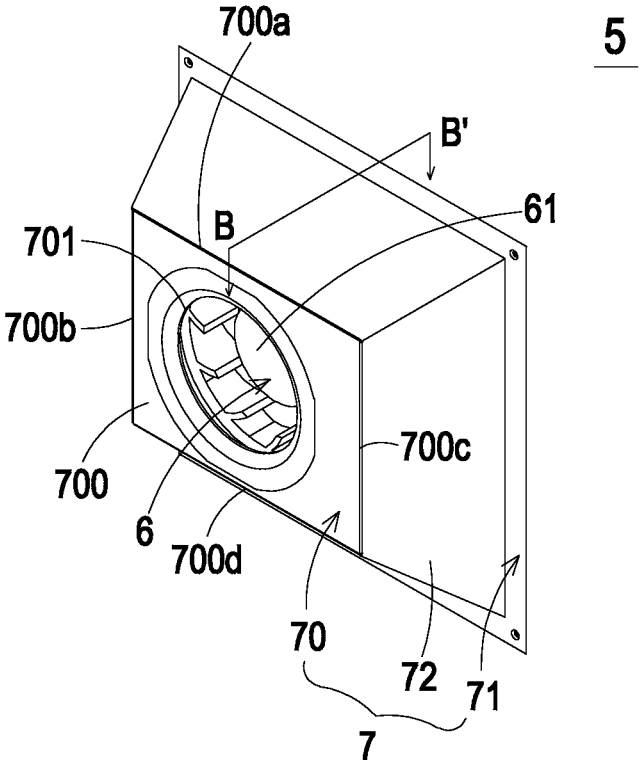
FIG. 5 is a schematic front view illustrating an integrated fan according to a second embodiment of the present invention.
Figure 6:
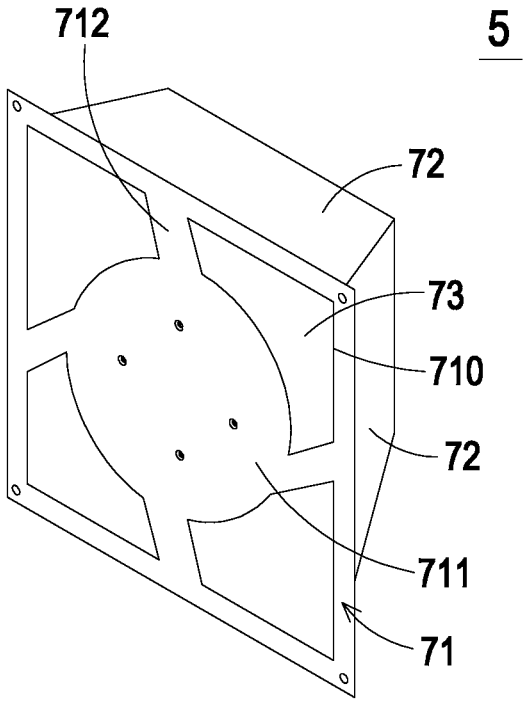
FIG. 6 is a schematic rear view illustrating the integrated fan shown in FIG. 5.
Figure 7:
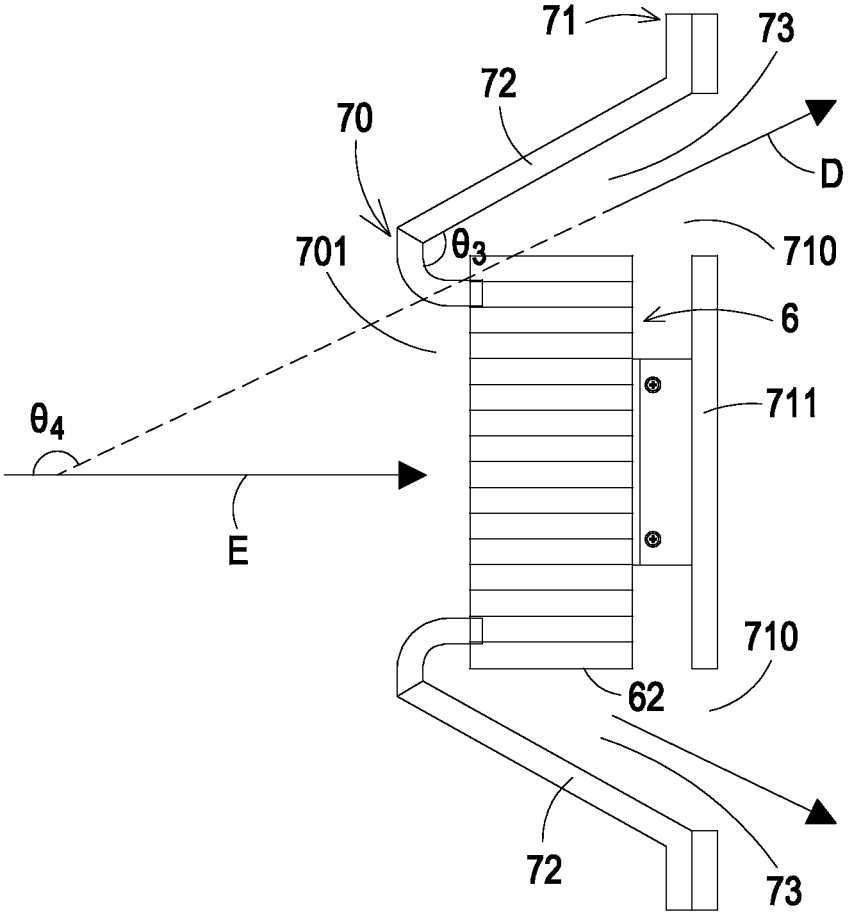
FIG. 7 is a schematic cross-sectional view illustrating the integrated fan shown in FIG. 5 and taken along the line B-B'.

FIG. 5 is a schematic front view illustrating an integrated fan according to a second embodiment of the present invention. FIG. 6 is a schematic rear view illustrating the integrated fan shown in FIG. 5. FIG. 7 is a schematic cross-sectional view illustrating the integrated fan shown in FIG. 5 and taken along the line B-B'. Please refer to FIGS. 5, 6 and 7. The integrated fan 5 may be applied to a cooling device (e.g. a heat exchanger as shown in FIG. 4). The integrated fan 5 principally comprises a centrifugal blade unit 6 and a frame 7. The centrifugal blade unit 6 is rotatable and arranged within the frame 7. That is, the centrifugal blade unit 6 is completely enclosed by the frame 7.

The frame 7 comprises a first casing 70, a second casing 71 and plural airflow-guiding plates 72. The first casing 70 comprises a main plate 700 and an airflow inlet 701. The airflow inlet 701 is disposed in the main plate 700, and aligned with the hub 61 of the centrifugal blade unit 6. Upon rotation of the centrifugal blade unit 6, the airflow is introduced into the space within the frame 7 through the airflow inlet 701.

The plural airflow-guiding plates 72 are aslant and extended from a first edge 700*a*, a second edge 700*b*, a third edge 700*c* and a fourth edge 700*d* of the main plate 700. The included angle θ3 between each of the airflow-guiding plates 72 and the main plate 700 is ranged between 90 and 180 degrees. In addition, each airflow-guiding plate 72 is partially aligned with the outer periphery 62 of the centrifugal blade unit 6. As such, upon rotation of the centrifugal blade unit 6, the airflow is introduced into the airflow inlet 601, and then turned by 90 degrees to be blown out of the outer periphery 62 of the centrifugal blade unit 6. Since the airflow blown out of the outer periphery 62 is hindered by the airflow-guiding plates 72, the path of the airflow is changed. In some embodiment, the airflow-guiding plates 72 are integrally formed with the main plate 700 of the first casing 70.

The second casing 71 is opposed to the main plate 700 of the first casing 70. In addition, the second casing 72 is connected with the plural airflow-guiding plates 72. The second casing 71 comprises plural apertures 710, a central part 711 and plural extension parts 712. The central part 711 is aligned with the centrifugal blade unit 6 for partially sheltering the centrifugal blade unit 6. The extension parts 712 are externally extended from the central part 711. The apertures 710 are collectively defined by the extension parts 712 and the central part 711.

Please refer to FIG. 7 again. In this embodiment, every two adjacent airflow-guiding plates 72, the first casing 70 and the central part 711 of the second casing 71 collectively define an airflow output channel 73. The airflow output channel 73 is partially aligned with the outer periphery 62 of the centrifugal blade unit 6, and in communication with corresponding apertures 710 of the first casing 70. Via the airflow output channel 73, the airflow blown out of the outer periphery 62 of the centrifugal blade unit 6 is guided and exhaust out of the frame 7. Since the airflow-guiding plate 72 is tilted and the included angle θ3 between the airflow-guiding plate 72 and the main plate 700 is ranged between 90 and 180 degrees, an included angle θ4 between the airflow-leaving direction D of the airflow output channel 73 and the airflow-entering direction E of the airflow output channel 73 (see FIG. 7) is also more than 90 degrees and less than 180 degrees. Upon rotation of the centrifugal blade unit 6, the included angle θ4 between the direction of the airflow introduced through the airflow inlet 701 and the direction of the airflow blown out of the airflow output channel 73 is more than 90 degrees and less than 180 degrees. Unlike the typical centrifugal fan, the included angle between the airflow-entering direction and the airflow-leaving direction of the integrated fan 5 is no longer 90 degrees. Due to the centrifugal blade unit 6, the integrated fan 5 has the benefits of the typical centrifugal fan (e.g. low noise and large air pressure) and the benefits of the typical axial-flow fan (e.g. high airflow capacity). Moreover, since the integrated fan 5 has plural airflow output channels 73, the airflow blown out of the outer periphery 62 of the centrifugal blade unit 6 will be uniformly exhausted out of the frame 7 to the surroundings. In other words, the airflow blown out of the integrated fan 5 is more uniform than the integrated fan 1 of FIG. 1.

From the above description, since the integrated fan of the present invention uses a centrifugal blade unit, the integrated fan 5 has the benefits of the typical centrifugal fan (e.g. low noise and large air pressure). Moreover, since the included angle between the airflow-guiding plate and the main plate is ranged between 90 and 180 degrees, upon rotation of the centrifugal blade unit, the included angle between the direction of the airflow introduced through the airflow inlet and the direction of the airflow blown out of the airflow output channel is more than 90 degrees and less than 180 degrees. In other words, the integrated fan of the present invention also has the benefits of the typical axial-flow fan (e.g. high airflow capacity).

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An integrated fan for use in a cooling device, said integrated fan comprising:

a centrifugal blade unit having a hub; and a frame for accommodating said centrifugal blade unit, wherein said frame comprises:

a first casing comprising a main plate and an airflow inlet, wherein said airflow inlet is disposed in said main plate and aligned with said hub;

a second casing opposed to said main plate of said first casing, wherein said second casing comprises a central part, plural extension parts and plural apertures, said central part is aligned with said centrifugal blade unit for partially sheltering said centrifugal blade unit; and plural airflow-guiding plates aslant and externally extended from plural edges of said main plate and connected with said second casing, wherein every two adjacent airflow-guiding plates, said first casing and said second casing define an airflow output channel, and each of said apertures is in communication with a corresponding airflow output channel, wherein an included angle between an airflow-leaving direction of said airflow output channel and an airflow-entering direction of said airflow inlet is more than 90 degrees and less than 180 degrees.

2. The integrated fan according to claim 1, wherein said extension parts are externally extended from said central part, and said plural apertures are defined by said extension parts and said central part.

3. The integrated fan according to claim 1, wherein an included angle between said airflow-guiding plate and said main plate is ranged between 90 and 180 degrees.

* * * * *